United States Patent [19]

Greenhut

[11] 4,058,695

[45] Nov. 15, 1977

[54] CALIBRATED ELECTRICAL MOTOR SWITCH

[76] Inventor: Joseph Greenhut, 3333 Warrensville Ctr. Road, Shaker Hts., Ohio 44122

[21] Appl. No.: 672,666

[22] Filed: Apr. 1, 1976

[51] Int. Cl.[2] ..... H01H 35/10

[52] U.S. Cl. ..... 200/153 V; 200/153 R; 200/80 R; 200/6 C

[58] Field of Search ..... 73/493, 538; 200/284, 200/244, 282, 283, 290, 303, 330, 335, 153 R, 153 V, 153 SC, 80 R, 6 C

[56] References Cited

U.S. PATENT DOCUMENTS

| | | | |
|---|---|---|---|
| 2,695,939 | 11/1954 | Filliette | 200/6 C |
| 3,272,950 | 9/1966 | Greenhut | 200/153 R |
| 3,805,005 | 4/1974 | Wilkinson | 200/284 |

*Primary Examiner*—Gerald P. Tolin
*Attorney, Agent, or Firm*—Isler & Ornstein

[57] ABSTRACT

An electrical starting winding switch for electrical motors having a calibrated single make and break contact with an unusually high opening force for the higher electrical values encountered in high density electrical motors while maintaining a much lower value of uniform contact closing force during the speed-responsive actuation of the switch.

7 Claims, 7 Drawing Figures

CALIBRATED ELECTRICAL MOTOR SWITCH

BACKGROUND OF THE INVENTION

In split phase motors it is necessary to provide an auxiliary or starting winding in the main winding circuit which will produce the required initial torque characteristics for starting the motor under load and bringing the motor up to an operating speed at which the main winding alone develops an adequate running torque, at which speed the starting winding circuit is opened. The mechanism for making and breaking the starting winding circuit consists of a stationary electrical switch which is mechanically engaged by a centrifugal speed-responsive rotary device which is mounted on the motor shaft. When the motor is rotating at a predetermined operating speed, the rotary device is withdrawn by centerifugal force from engagement with the normally open stationary switch and the starting winding circuit is inoperative. If the rotation of the motor ceases or is reduced below a critical value, the centrifugal forces acting on the rotary device are reduced and the rotary device engages the stationary switch to close the starting winding circuit. For a more detailed description of the forms and operation of such prior art switching arrangements, reference is made to my U.S. Pat. Nos. 2,616,682 and 3,272,950.

The aforementioned patents discuss and describe the critical nature of the forces involved in obtaining uniformity of operation in such starting winding devices and the variables which have to be considered and for which appropriate compensation has to be provided in design and arrangement if an improved standard of performance is to be achieved.

With the advent of high density electrical motors which impress higher electrical values on the winding circuits, it becomes more important to obtain high force or energy levels for opening of the switch contacts while maintaining a uniform and constant contact-closing force which will not unduly oppose and negate the opening force.

SUMMARY OF THE INVENTION

It is a primary object of the invention to provide an improved stationary starting winding switch for electrical motors in which contact-opening forces of relatively large magnitude can be obtained without sacrifice of sensitivity of calibration.

Another object of my invention is to provide a switch of the character described in which there is a substantial differential between the large contact-opening force and a much lesser value of contact-closing force.

Still another object of my invention is to provide the foregoing characteristics without increasing the physical size of the switch.

A further object of my invention is to provide a switch which will maintain a substantially uniform value of reaction force to the engaging action of the rotary actuating device.

Other objects and advantages of my invention will appear more fully during the course of the following description.

BRIEF DESCRIPTION OF THE DRAWING

In the drawings, in which like numerals are used to designate like parts throughout the same.

DESCRIPTION OF THE PREFERRED EMBODIMENTS

Figure 1:
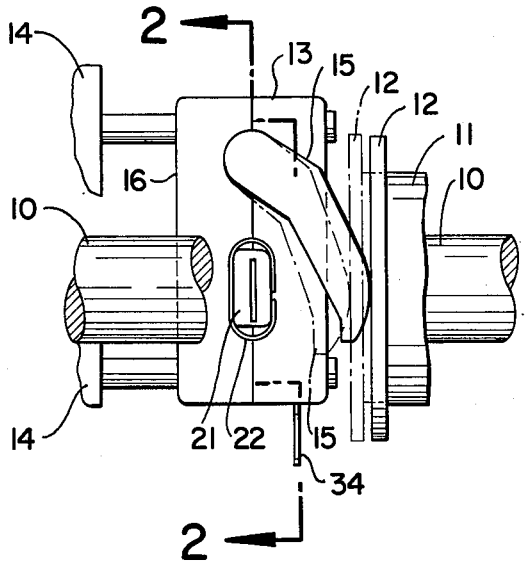
FIG. 1 is a view in elevation of a stationary switch embodying the features of my invention as it appears when mounted to be engaged by a shaft-mounted rotary speed-responsive device of an electrical motor, the closed position of the switch being indicated in phantom outline.

Referring more particularly to FIG. 1 of the drawings, there is shown a fragmentary portion of an electric motor to illustrate the field of use of the invention. A motor shaft 10 has axially mounted thereon a centrifugal speed-responsive device 11 which rotates with the shaft and has a longitudinally movable shoe 12 which has a snap-action withdrawal from operative engagement with a stationary switch 13 when a predetermined running speed of the motor is attained. The switch 13 is in circuit with the starting winding of the motor and is secured to the motor housing 14 in a predetermined position for operative engagement by the the shoe 12. The switch shown is of the enclosed type, but the principles of the invention can be applied equally to a non-enclosed switch.

When the motor is at rest or has not yet attained the starting winding cut-out speed, the shoe 12 is in the advanced position shown in phantom outline in FIG. 1 and the switch contacts are closed. At the cut-out speed, the shoe 12 retracts to the solid line position shown in FIG. 1 and the switch contacts to the starting winding circuit are open. The shoe 12 engages a switch-actuating lever arm 15 which is provided on the switching device 13 and which controls the opening and closing of the switch contacts.

Figure 2:
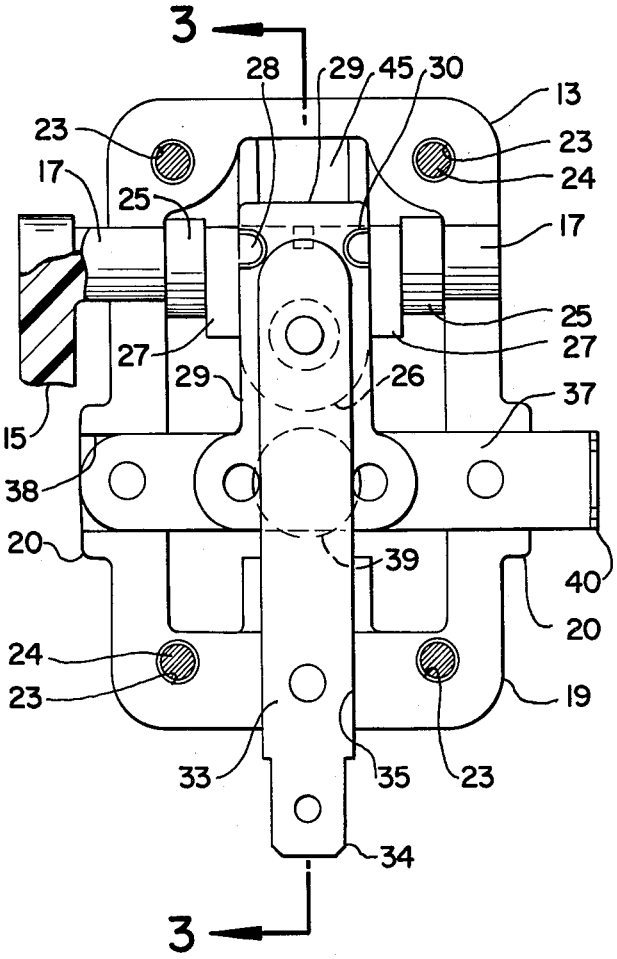
FIG. 2 is an enlarged cross-sectional view of the switch taken as indicated on line 2—2 of FIG. 1.
Figure 3:
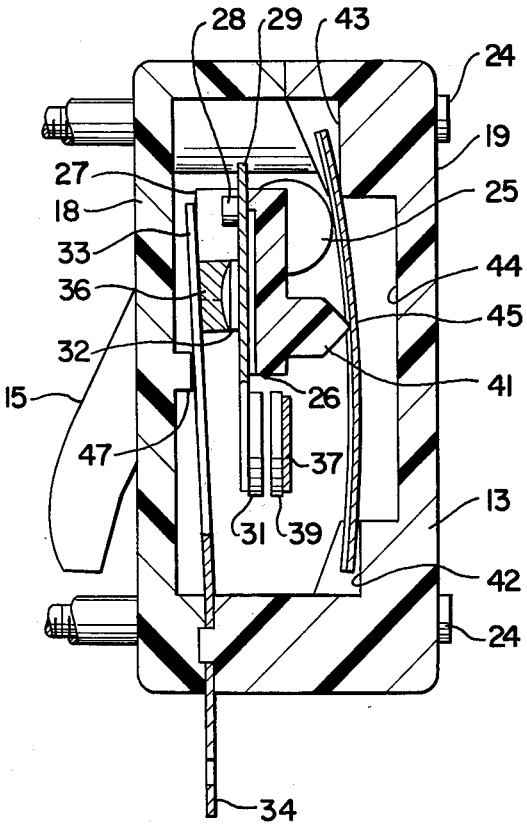
FIG. 3 is a cross-sectional view of the switch in open position taken as indicated on line 3—3 of FIG. 2.

As best seen in FIGS. 2 and 3, the switch 13 includes a housing 16 in which is journalled the stem or shaft 17 of the lever arm 15 which extends exteriorly of the housing into abutment with the shoe 12 of the centrifugal device 11. The housing consists of two assembled halves 18 and 19 which are preferably injection molded of synthetic resin. Each half of the housing is provided with oppositely disposed external projections 20 which, when the halves are assembled, form an apertured or slotted boss 21 for receiving an outer spring clip 22 for retaining the housing halves in assembled relationship. Transversely extending openings 23 are provided in the housing to receive mounting bolts 24 which can also serve to secure the housing halves to each other, if desired.

The stem 17 of the lever arm is provided with longitudinally-spaced collars 25 adjacent the interior wall surface of the housing 16 to retain the shaft against axial displacement. Centrally of the stem is a table or substantially plane support surface 26 having a pair of oppositely disposed retaining walls 27 with inwardly extending projections 28 defining spaced pivot points for a notched contact plate 29 which is adapted to rest upon the table 26.

The notched portions 30 of the plate lie slightly rearwardly of the pivotal axis of the shaft 17. The opposite or forward end of the plate is provided with an electrical contact 31 on the underside thereof. Another electrical contact 32 of convex form is provided on the upper side of the plate 29 in a position forward of the pivotal axis of the shaft 17, but rearward of the location of the contact 31. The contact 32 has electrical continuity with the contact 31 through the electro-conductive plate 29.

A cantilever-mounted leaf spring 33 has a terminal connector portion 34 clamped in a slot 35 between the halves of the housing 16 and projecting exteriorly thereof. The free opposite end of the leaf spring projects interiorly of the housing and is provided with a concave electrical contact 36 which is resiliently maintained by the leaf spring in electrical abutment with the convex plate contact 32 thus providing a form of semi-spherical joint between these two contacts.

A substantially rigid conductive element 37 is clamped between the halves of the housing 16 in the slots 38 provided by the housing projections 20. The element 37 carries an electrical contact 39 which underlies and is disposed in the path of movement of the contact 31 of the plate 29. One end of the element 37 extends exteriorly of the housing 16 to provide a terminal connector portion 40. When the appropriate leads are connected to the terminals 34 and 40, respectively, the energizing circuit to the starting winding is completed through the closing of the pair of contacts 31, 39. The separation of these contact opens or breaks the circuit.

Figure 6:
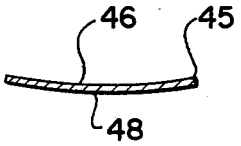
FIG. 6 is a fragmentary cross sectional view showing the configuration of the contact-opening spring.

The support table 26 has a depending extension or finger 41 which moves bodily with the table as it pivots about the longitudinal axis defined by the stem 17 in response to movement of the switch-actuating lever arm 15. A pair of spaced support recesses 42 and 43 are molded into the lower housing half 19 in elevated position above the interior wall 44 of the housing. The support recess 43, which is rearward of the stem 17, is elevated above the recess 42. These recesses are adapted to receive and support the opposite ends of a resilient leaf spring 45 having a concavoconvex transverse cross-sectional configuration which increases its resistance to deflecton while still maintaining a characteristic substantially uniform load or force over a broad range of deflection. For brevity, the leaf spring 45 will hereinafter be termed a "rule" spring. By reason of its transverse curvature, shown in FIG. 6, it is capable of exerting a substantially greater force than a like flat leaf spring of the same size similarly supported. The recesses 42-43 support the spring 45 spaced from the housing surface 44 and at a slight angle of about 5-10° relatively thereto. The finger 41 engages the concave face 46 of the spring.

The operation of the switching device will now be described. When the motor is at its normal running speed, above the cut-out speed to which the switch is calibrated, the shoe 12 of the centrifugal device 11 is retracted as shown in FIG. 1 so that the spring 45 acting on the fnger 41 is free to maintain the lever arm 15 in its outermost inoperative position, as shown in FIG. 3. This position is limited by the abutment of the contact-closing spring 33 with a guide recess 47 provided for that purpose on the upper housing half 18. The contacts 31 and 39 are not in abutment with each other and the starting winding circuit is open.

It will be noted that the finger 41 and the lever arm 15 integrated therewith are loading and deflecting the rule spring 45 even when the lever arm is in its outermost position, so that the force or resistance presented by the lever arm to the rotary device 11 is substantially constant regardless of whether the shoe 12 is advanced or retracted. This results in a consistency of performance by the speed-responsive switching assembly at the calibrated cut-out speed of the motor.

The contact-opening spring 45 may, for example, exert a substantially constant force of relatively large magnitude which is effectively 300 grams of opening force at the plate supported contact 31. The contact-closing spring 33 may, for example, exert a substantially constant opposing force of 100 grams at the contacts 32, 36 which, as a consequence of the lever provided by plate 29, translates into a contact closing force of 40 grams at the contact 31. Thus, there is a substantial differential between the opening and closing forces on the pair of contacts 31, 39 which is of sufficient magnitude to provide quick and effective opening of the contacts in response to snap-action retraction of the speed-actuated shoe 12, to accommodate to the high electrical values imposed on the contacts by the circuits of high density motors. Furthermore, the entire opening force is concentrated on only the one contact area between the contacts 31, 39 in contrast to being spread or dissipated over two or more pairs of contacts.

Figure 4:
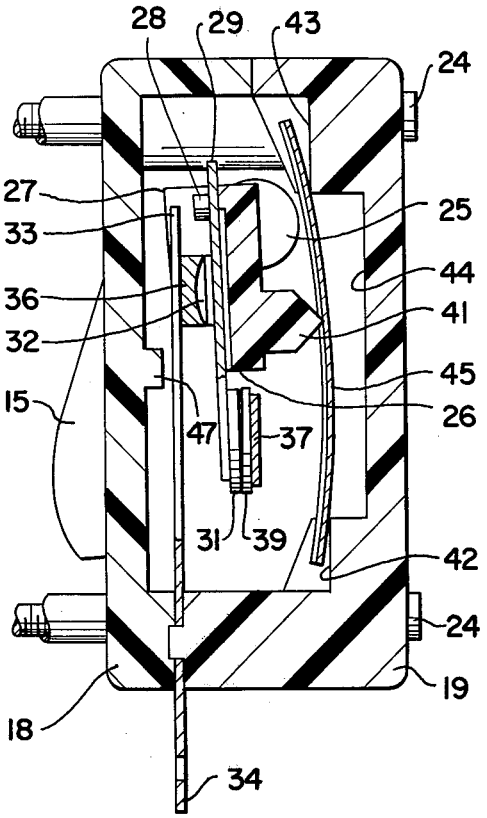
FIG. 4 is a cross-sectional view similar to FIG. 3, but showing the switch in initial closed position.

When the speed of the motor falls below the switch cut-in speed, as by overload or when the motor is deenergized, the shoe 12 advances to the position shown in phantom outline in FIG. 1 and displaces or depresses the lever arm 15 to the position shown in FIG. 4. The rotation of the lever arm causes corresponding pivotal movement of the support table 26 to lower its forward end in the direction of the rule spring 45 causing further deflection of spring 45 by the finger 41. This movement of the table isolates the contact plate 29 from the action of spring 45 and permits the cantilever spring 33 to exert an effective force at the spherical contact joint 32, 36 causing the plate to follow the pivotal movement of the support table until the contact 31 on the plate abuts the contact 39 to reestablish the starting winding circuit. The cantilever mounting of leaf spring 33 results in the maintenance of a uniform, constant value of contact-closing force independently of the magnitude of force of spring 45.

Figure 5:
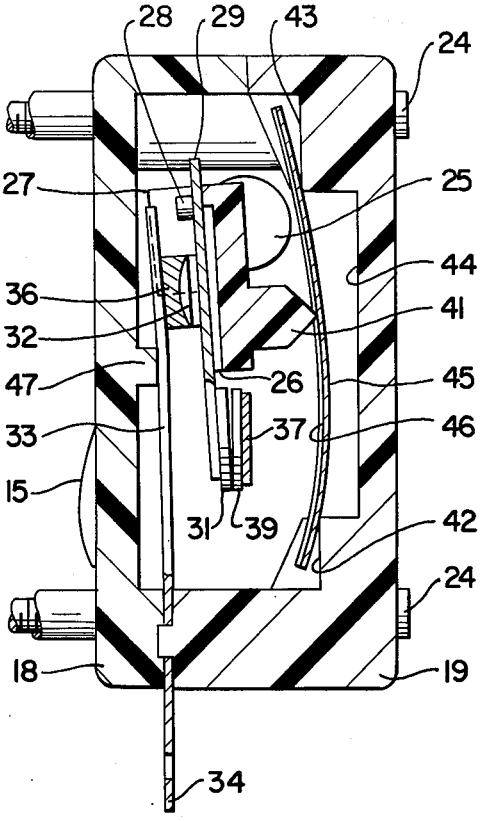
FIG. 5 is a cross-sectional view similar to FIG. 4 but showing the position of the parts of the switch after overrun of the switch lever arm.

If there is any overrun of the lever arm 15 beyond the point where the contacts 31 and 39 abut, the support table 26 continues its pivotal movement, but the following movement of the contact plate 29 is arrested. However, as shown in FIG. 5, such continued pivotal movement of the support table causes its rearward portion to elevate the rearward part of the contact plate thereby slightly raising the contact 32 and correspondingly raising the free end of the cantilever leaf spring 33 until the spring bottoms on the guide recess 47. This creates a slight deflection of the spring 33 which urges counter-rotation of the table 26 and thus initially supplements and augments the contact-opening force on the contacts 31, 39 which is principally provided by the spring 45 when the lever arm 15 is released from its depressed position by retraction of shoe 12. Thereby the force of spring 33 is primarily utilized as a contact-closing force, but, if there is over-travel of shoe 12, the role of spring 33 is reversed initially to provide a contact-opening force to supplement and augment the contact-opening force provided by spring 45. It will be apparent that during all the described movements of the contact plate 29, the contacts 32, 36 are maintained in abutment.

Figure 7:
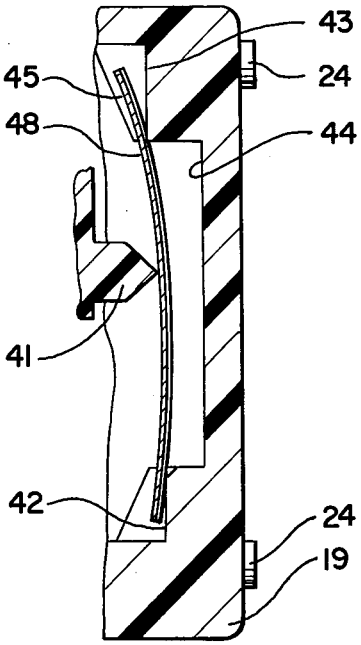
FIG. 7 is a fragmentary cross-sectional view similar to FIG. 3 and showing a modified form of the switch.

FIG. 7 illustrates the manner in which a component of the switch 13 can be rearranged to construct a switch which would have approximately twice the contact-opening force of the previously described form of switch. It is to be understood that such a change would have to be correlated to an appropriate change in the cut-out speed or operating force of the centrifugal device which is utilized.

In the switch shown in FIG. 7, the rule spring 45 has been installed with its convex face 48, rather than its concave face 46, abutting the finger 41. The characteristic of the rule spring 45 is that its convex face has much greater resistance to deflection under load than does the concave face. The spring 45 exerts approximately twice as much contact-opening force when its convex face is utilized as it does when its concave face is utilized. This characteristic permits the same components of the switch to be used in achieving two greatly different operating characteristics.

It is to be understood that the forms of my invention, herewith shown and described, are to be taken as preferred examples of the same, and that various changes in the shape, size and arrangement of parts may be resorted to, without departing from the spirit of my invention, or the scope of the subjoined claims.

Having thus described my invention, I claim:

1. In an electrical switch, the combination of a pivotally movable conductive contact plate carrying a first electrical contact, a single fixed second electrical contact disposed in the path of circuit-closing movement of said plate, a circuit element in the form of a constant-tension cantilever-mounted leaf spring maintaining its free end bearing upon and in electrical contact with said plate and yieldably urging said plate into circuit-closing engagement with said second electrical contact, second spring means yieldably urging said plate into circuit-opening position in opposition to said cantilevered spring, said second spring means having a greater force than said cantilevered spring, movable switch-actuating means interposed between and engaging said plate and said second spring means to selectively isolate said plate from the contact-opening force exerted by said second spring means and cause closing of said contacts by said cantilevered spring in response to closing movement of said switch-actuating means, and terminal connector portions provided for said fixed contact and on said cantilever spring for connecting them into an electrical circuit.

2. A combination as defined in claim 1, wherein said contact plate is provided with a third electrical contact remote from said first contact, and the free end of said cantilevered spring is provided with a fourth electrical contact movably maintaining electrical continuity with said third contact during circuit-opening and circuit-closing movement of said plate.

3. A combination as defined in claim 1, wherein said switch-actuating means has a lost-motion connection with said contact plate whereby it can pivotally over-travel the circuit-closing position of said contact plate.

4. A combination as defined in claim 3, wherein said over-travel of said switch-actuating means causes counter-displacement of said cantilevered spring to cause said spring to exert a circuit-opening force on said contact plate.

5. A combination as defined in claim 1, wherein said second spring means is a leaf spring having a concavo-convex cross-sectional configuration and supported at both its ends for deflection by said switch-actuating means intermediate said ends.

6. A combination as defined in claim 5, wherein said second spring means presents a concave surface to engagement by said switch-actuating means.

7. A combination as defined in claim 5, wherein said second spring means presents a convex surface to engagement by said switch-actuating means.

* * * * *